US009939224B2

(12) United States Patent
Fischer

(10) Patent No.: US 9,939,224 B2
(45) Date of Patent: Apr. 10, 2018

(54) SILENCER

(71) Applicant: Andreas Steindl, Tulln (AT)

(72) Inventor: Oliver Fischer, Hard (AT)

(73) Assignee: Andreas Steindl, Tulln (AT)

( * ) Notice: Subject to any disclaimer, the term of this patent is extended or adjusted under 35 U.S.C. 154(b) by 0 days.

(21) Appl. No.: 14/988,356

(22) Filed: Jan. 5, 2016

(65) Prior Publication Data

US 2016/0209149 A1 Jul. 21, 2016

Related U.S. Application Data

(63) Continuation of application No. PCT/EP2014/064481, filed on Jul. 7, 2014.

(30) Foreign Application Priority Data

Jul. 5, 2013 (DE) ..... 10 2013 107 115

(51) Int. Cl.
*F41A 21/30* (2006.01)
*F41A 21/32* (2006.01)
*F41C 33/02* (2006.01)

(52) U.S. Cl.
CPC ..... *F41A 21/30* (2013.01); *F41A 21/325* (2013.01); *F41C 33/02* (2013.01)

(58) Field of Classification Search
CPC ..... F41A 21/30; F41A 21/325; F41A 21/34; F41A 21/36; F41A 21/38
USPC ..... 89/14.2, 14.3, 14.4, 14.5; 42/1.06; 181/223
See application file for complete search history.

(56) References Cited

U.S. PATENT DOCUMENTS 4,944,213 A * 7/1990 Ewert ..... F41A 21/325 89/14.3
5,136,924 A * 8/1992 Forster ..... F41A 21/325 89/14.4
5,831,202 A * 11/1998 Rustick ..... F41A 21/26 42/124
6,267,279 B1 7/2001 Matthews
7,194,836 B1 * 3/2007 Urban ..... F41C 27/22 42/106

(Continued)

FOREIGN PATENT DOCUMENTS

DE 42 31 183 C1 3/1994
DE 198 15 467 A1 10/1999

(Continued)

OTHER PUBLICATIONS

International Search Report, dated Oct. 23, 2014, with written opinion for international application PCT/EP2014/064481.

(Continued)

*Primary Examiner* — Bret Hayes
(74) *Attorney, Agent, or Firm* — Myers Wolin, LLC

(57) ABSTRACT

A silencer for a firearm, in particular a handgun, is provided, comprising a silencer housing with a rear end wall, which is facing the barrel of the firearm, and a front end wall, which is remote from the rear end wall, and comprising an attachment rail, arranged on the silencer housing, for attaching the silencer to the firearm. The attachment rail is arranged on a lower side wall of the silencer housing. The silencer may also be used as a duel simulator. Also provided is a firearm with a silencer or a duel simulator.

19 Claims, 11 Drawing Sheets

(56) References Cited

U.S. PATENT DOCUMENTS

| | | | | |
|---|---|---|---|---|
| 2011/0067950 | A1* | 3/2011 | Shults | F41A 21/30 181/223 |
| 2011/0186377 | A1* | 8/2011 | Kline | F41A 21/30 181/223 |
| 2014/0157640 | A1* | 6/2014 | Whelan | F41A 21/30 42/75.02 |
| 2014/0353076 | A1* | 12/2014 | Bethlenfalvy | F41A 21/30 181/223 |
| 2015/0090105 | A1* | 4/2015 | Pace | F41A 21/30 89/14.4 |
| 2015/0362276 | A1* | 12/2015 | Fischer | F41G 11/003 89/14.4 |

FOREIGN PATENT DOCUMENTS

| | | | |
|---|---|---|---|
| DE | 10 2006 025 245 | A1 | 12/2007 |
| DE | 10 2006 025245 | A1 | 12/2007 |
| WO | 2008/119098 | A1 | 10/2008 |

OTHER PUBLICATIONS

Relevant part of a German Search Report issued for corresponding German Patent Application 10 2013 107 115.5 dated Jun. 25, 2014 with an English translation of the full report.

* cited by examiner (a)

(b)

(a)

(b)

(c)

(a)

(b)

(a)

(b)

SILENCER

CROSS REFERENCE TO RELATED APPLICATIONS

The present application is a continuation of International Application No. PCT/EP2014/064481, filed on Jul. 7, 2014, which claims priority to German Patent Application No. DE 10 2013 107 115.5, filed on Jul. 5, 2013, the contents of each of which are incorporated herein by reference.

SUBJECT MATTER OF THE INVENTION

The invention relates to a silencer for a handgun as well as a handgun with a silencer according to the invention.

PRIOR ART AND BACKGROUND

The term "handguns" relates to pistols, e.g., blowback operated weapons, or gas operated weapons, guns, and the like. The invention will be described by means of the example of a handgun, although the present invention is not limited to the latter and might just as well be implemented in long guns.

It is known to equip firearms with a silencer in order to reduce noise emission, which emanates from gases escaping upon a gunshot from the muzzle expanding explosively and being under high pressure.

Silencers can be screwed onto a front end of the gun barrel. Such a silencer is, for example, known from DE 42 31 183 C1.

With respect to handguns with a fixed barrel, the silencer only causes slight problems concerning the self-loading function of the gun.

With respect to handguns with a movable barrel, the maintenance of the self-loading function of the gun has been found to be problematic. This is because a silencer screwed onto the barrel or the breech increases the mass which is returned during a shot, whereby the return velocity decreases from the barrel to the breech. This may result in the self-loading function of the gun either being stopped completely, or functional disorders occurring, because, for example, the ejection of the empty cartridge and/or the supply of a new cartridge may only take place incompletely and the gun does no longer lock completely. This is specifically problematic with respect to guns, which have a rearward-moving and pivoting barrel (Browning principle), because here, the silencer also still has to be raised.

In practice, it has been tried to solve this problem by more light-weight or smaller silencers. This, however, has the disadvantage that with correspondingly light-weight silencers, the stability of the silencer decreases, and that with respect to smaller silencers, the sound-absorbing effect occasionally may deteriorate substantially.

A solution for this problem is, to instead of connecting the silencer and the gun barrel to each other rigidly, to rather arrange a so-called pulse generator between the silencer and the gun barrel, which on the one hand, is connected to the silencer, and on the other hand is connected to the gun barrel, and which allows for an axial movement of the gun barrel relative to the silencer. Thus, by means of the pulse generator, the gun barrel is decoupled from the silencer such that the self-loading function of the gun despite the silencer is ensured as far as possible.

The use of pulse generators, however, has the disadvantage that these may easily get dirty and/or damages at the threads of the pulse generator may lead to impairment of the function of the gun. Moreover, the production of the pulse generator is relatively complex and expensive, which negatively affects the price of a silencer.

For silencers, which are screwed directly onto the front end of the gun barrel as well as for silencers, which are fixed to the end of the gun barrel via a pulse generator, it is disadvantageous that the mounting of the silencer as well as the demounting of the silencer takes relatively much time. Further, during screwing of the silencer, it always has to be ensured that the latter is fixedly screwed.

OBJECT OF THE INVENTION

Therefore, it is an object of the invention to provide a silencer for a handgun, which allows for an easy, secure, and quick mounting or demounting of the silencer at the handgun, and which can be used for handguns with self-loading function or with a movable barrel, also without a pulse generator, without the self-loading function being impaired.

Solution According to the Invention

This object is solved according to the invention by a silencer for a handgun as well as by a handgun with a silencer according to the invention as specified in the independent claims. Preferred embodiments and further developments of the invention are specified in the respective dependent claims.

Accordingly, a silencer for a gun is provided, in particular, a handgun, comprising

- a silencer housing with a rear end wall, which faces the gun barrel of the gun, and with a front end wall opposing the rear end wall, and
- a fixation rail arranged at the silencer housing for fixing the silencer to the gun.

The fixation rail may be arranged at a lower side wall of the silencer housing. The lower side wall is arranged between the rear end wall and the front end wall or extends between the rear end wall and the front end wall. Preferably, the lower side wall connects the rear end wall with the front end wall. Preferably, the lower side wall is arranged at an angle of 90° with respect to the rear end wall and/or with respect to the front end wall.

By providing the fixation rail, it is advantageously enabled that the silencer can be fixed at a fixation rail of the gun or firearm without the silencer having to be screwed to the gun barrel of the gun or firearm. The silencer may be simply fitted on the fixation rail, which is arranged at the lower side of the grip stock of the weapon. Thereby, a particularly simple and quick mounting and demounting of the silencer at or from the weapon is enabled.

Thereby, the silencer may be fixed to the fixation rail protruding beyond the gun barrel. Alternatively, a connection rail may be used, which is fixed to the weapon or gun and which protrudes beyond the gun barrel after fixation, whereby the silencer is fixed at the connection rail by means of its fixation rail. For example, a grip stock may be arranged at the lower side of the connection rail.

Preferably, exactly one fixation rail is provided. In fact, two fixation rails arranged at the silencer laterally would be detrimental in that during mounting, the fit has to be taken care of on both sides leading to a slower mounting, because both fixation rails have to be fitted on the corresponding counterpart at the gun.

In the silencer housing, a shot channel for a bullet may be formed between the rear end wall and the front end wall. The shot channel may run parallel to the longitudinal axis of the silencer housing.

The fixation rail may extend parallel to the longitudinal axis of the silencer housing.

It is advantageous, if the fixation rail has at least one longitudinal guide.

The at least one longitudinal guide may run parallel to the longitudinal axis of the silencer housing or the fixation rail. Alternatively, the longitudinal guide may also run transversely to the longitudinal axis of the silencer housing or the fixation rail.

The fixation rail may project beyond the rear end wall of the silencer housing.

The fixation rail preferably has a substantially U-shaped profile, in particular, in the region projecting beyond the rear end wall.

The at least one longitudinal guide may comprise a first longitudinal guide and a second longitudinal guide, wherein the first longitudinal guide is formed at the inner surface of a first side wall of the U-shaped profile, and the second longitudinal guide is formed at the inner surface of a second side wall of the U-shaped profile.

At least one open transverse channel may be formed in the fixation rail for receiving a locking and/or arresting means.

The rear end wall may comprise a receiving aperture, which can be brought into engagement with a front end of a gun barrel. The fixation guide may be arranged below the receiving aperture.

It is advantageous, if the internal profile of the U-shaped profile of the fixation rail substantially corresponds to an external profile of a mounting rail of the gun, in order to bring the fixation rail into engagement with the mounting rail, in order to releasably connect the silencer to the gun.

According to an embodiment of the silencer, the fixation rail may at least partially be formed as a mounting rail. Thereby, on the one hand, the silencer may be fixed at the gun, and on the other hand, additional devices, for example, a tactical light may be fixed to the silencer.

The mounting rail may extend basically over the entire length of the silencer housing.

The front end wall of the silencer housing may be configured as a cover which is releasable from the silencer housing.

The cover may be configured trough-shaped.

According to an embodiment of the silencer, in the silencer housing between the rear end wall and the front end wall, a light channel running parallel to the longitudinal axis of the silencer housing may be arranged with an inlet opening at the rear end wall and an outlet opening at the front end wall.

The light channel preferably is configured in a pressure- and/or air-tight manner against a gas chamber of the silencer.

In the front end wall, and illuminant, preferably a laser diode, may be arranged.

In the silencer housing, control electronics and/or a power supply for the illuminant may be provided.

The illuminant, the control electronics, and the power supply may be arranged within a preferably air- and/or pressure tight housing, wherein the illuminant is arranged within the sidewall of the housing, and wherein the housing and the components (illuminant, control electronics, and power supply) arranged therein together form an illuminant module.

In the silencer housing, a recess may be provided in the area of the front end wall for receiving the illuminant module.

According to an embodiment of the invention, the control electronics or the illuminant module may comprise a sensor unit for detecting of a firing off of ammunition, in particular, blank ammunition and/or maneuver ammunition.

Preferably, the sensor unit comprises a pressure sensor and/or an acoustic sensor.

According to an embodiment of the invention, the silencer may be configured as duel simulator, wherein an expansion chamber is formed within the silencer housing, to which an overpressure channel leads, which is provided for discharging the gases expanding in the expansion chamber. Thereby, the silencer may be used as duel simulator, which may be fixed particularly simple and secure to a mounting rail of the weapon. Thereby, a screwing of the duel simulator onto the gun barrel it is not necessary.

In the silencer housing (or the housing of the silencer which is provided as duel simulator), a receiving channel may be arranged between the rear end wall and the front end wall, wherein the expansion chamber is formed within the receiving channel.

In the receiving channel, a bulkhead may be arranged, which delimits the expansion chamber towards the front end wall, preferably, delimits the latter in a pressure tight manner.

The expansion chamber may be arranged coaxially with respect to the gun barrel, and may be coupled from the gun side to the gun barrel almost pressure-tightly.

The expansion chamber, on the gun barrel side, may be closable by a reducer arranged at the muzzle opening of the gun barrel, wherein the reducer comprises a longitudinal channel, which connects the expansion chamber to the gun barrel, i.e., to the inner space of the gun barrel.

The illuminant module may be arranged behind the bulkhead, i.e., towards the front end wall.

The bulkhead may be movable within the receiving channel in a longitudinal direction relative to the receiving channel. Thereby, the volume of the expansion chamber may be adapted.

The control electronics may be adapted to instruct, after a detection of a firing off of ammunition, the illuminant to emit a light ray, preferably, a laser beam, particularly preferred, an encoded laser beam.

A cover plate may be arranged in front of the rear end wall (i.e., outside of the silencer housing) and basically parallel to the rear end wall, which is movable in vertical direction relative to the rear end wall. The cover plate may be provided in a silencer according to the invention as well as in a silencer provided as duel simulator.

The cover plate preferably comprises an opening or recess preferably concentric with respect to the receiving aperture of the silencer housing, which completely penetrates through the cover plate, and which basically has the same size and shape as the receiving aperture.

At the lower side of the cover plate, a spring member may be arranged.

At the side of the cover plate facing the rear end wall, guide rails or guide gaps may be provided (it may also be provided only one guide rail or guide gap), which engage into the guide gaps or guide rail at the rear end wall.

The guide gaps and guide rails may be formed as a dovetail guide.

In the cover plate, below the opening or recess, a hole, preferably an elongated hole, may be provided.

It is particularly preferred, if an upper wall of the silencer housing running between the rear end wall and the front end wall, after mounting to the weapon, is flush with the breech of the weapon.

It has been found to be specifically advantageous, if an upper portion of the silencer housing substantially has the same external profile and/or the same size as the upper portion of the breech of the weapon.

The silencer housing and the fixation rail may be formed as one part or as one piece.

Further, a duel simulator for a gun is provided, comprising a housing with a rear end wall, which faces the gun barrel of the firearm, and with a front end wall opposing the rear end wall, and a fixation rail arranged at the silencer housing for fixing the duel simulator to the gun.

Thereby, the duel simulator may be fixed at a mounting rail of the gun or firearm particularly simple and secure. A screwing of the duel simulator onto the gun barrel, thereby, is not necessary.

In the housing of the duel simulator, an expansion chamber may be formed, into which an overpressure channel leads, which is provided for discharging of gases expanding in the expansion chamber.

In the housing, a receiving channel may be arranged between the rear end wall and the front end wall, wherein the expansion chamber is formed within the receiving channel.

In the receiving channel, a bulkhead may be arranged, which delimits the expansion chamber towards the front end wall, preferably, in a pressure tight manner.

The expansion chamber may be arranged coaxially with respect to a gun barrel, and may be coupled at the gun barrel side substantially pressure tightly.

The expansion chamber, on the gun barrel side, may be closed by a reducer arranged at the muzzle opening of the gun barrel, wherein the reducer comprises a longitudinal channel, which connects the expansion chamber to the gun barrel, i.e., to the internal space of the gun barrel.

An illuminant module may be arranged behind the bulkhead, i.e., towards the front end wall.

The bulkhead may be movable within the receiving channel in the longitudinal direction relative to the receiving channel. Thereby, the volume of the expansion chamber may be adjusted.

A control electronics of the illuminant module may be adapted to detect a firing off of ammunition (e.g., blank and/or maneuver ammunition), preferably, by means of a pressure sensor and/or an acoustic sensor. The control electronics may further be adapted to instruct an illuminant of the illuminant module, after a detection of a firing off of ammunition, to emit a light ray, preferably, a laser beam, particularly preferably, an encoded laser beam.

Further, a gun, in particular, a handgun, is provided comprising a silencer according to the invention or a duel simulator according to the invention.

Further, a holster for holstering a gun, in particular, a handgun, is provided, wherein the holster is adapted to holster the gun with a silencer according to the invention fixed thereto, or with a duel simulator according to the invention fixed thereto.

BRIEF DESCRIPTION OF THE FIGURES

Details and features of the invention can be derived from the following description in connection with the drawing, in which.

DETAILED DESCRIPTION OF THE INVENTION

The silencer according to the invention described in the following has the substantial advantage that it may be fixed or mounted and demounted in a particularly simple, safe, and quick manner, in particular, without a screwing onto the gun. A further substantial advantage of the silencer according to the invention lies therein that it can also be used for handguns, which have a movable barrel or a self-loading function, without having to use a pulse generator for this, wherein the self-loading function of the handgun nevertheless is maintained. The use of the silencer according to the invention has been found to be specifically advantageous for handguns, which have a rearward-moving and pivoting barrel.

Figure 1A:
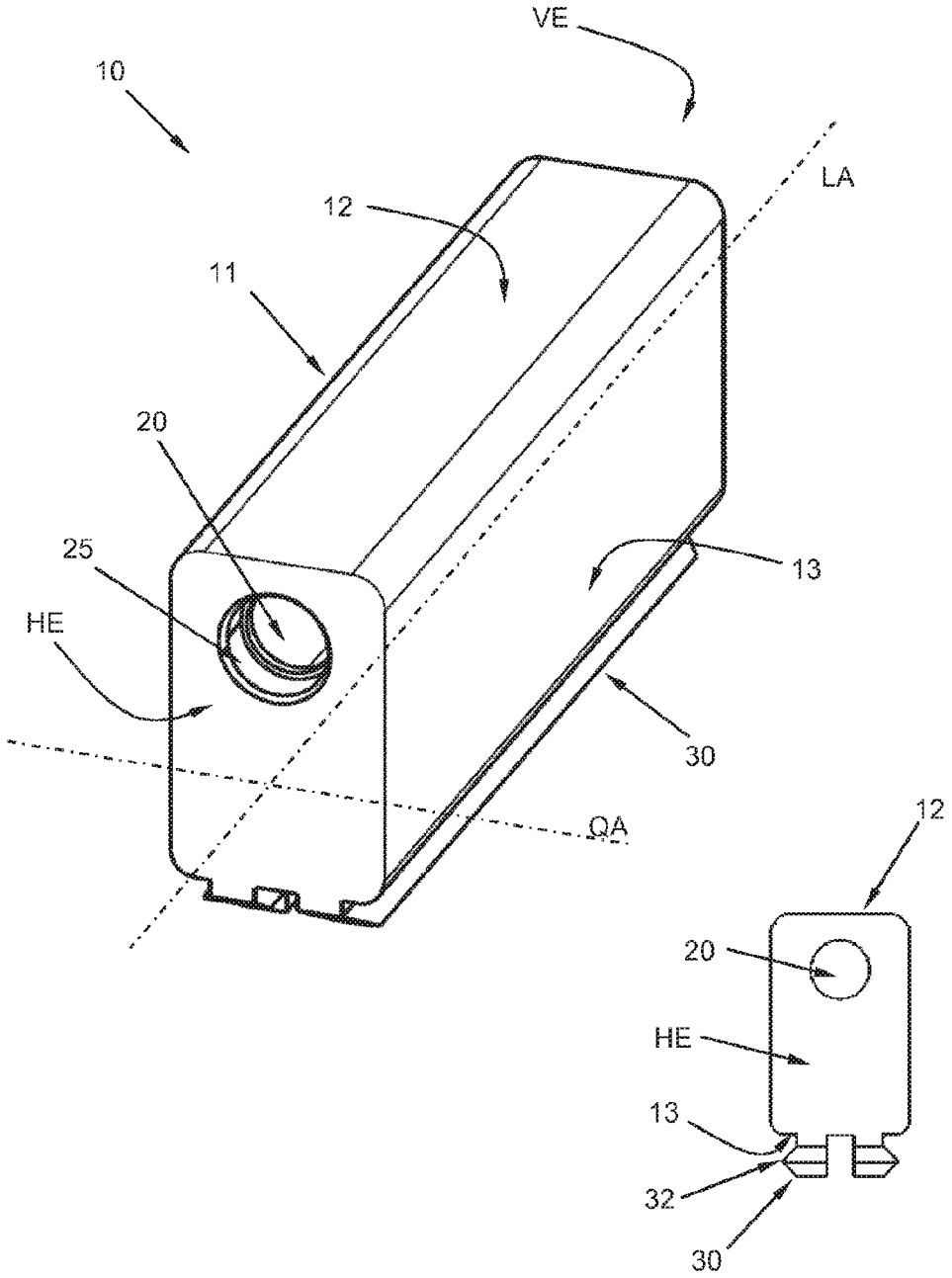
FIG. 1*a* shows a silencer according to the invention in a perspective view and in sectional view.

FIG. 1*a* shows a silencer 10 according to the invention in a perspective view and in a cross-sectional view.

The silencer in the embodiment shown here comprises a substantially rectangular shaped silencer housing 11 and a fixation rail 30, which here is arranged at a lower side 13 of the silencer housing. The silencer housing may also have a substantially cylindrical shape, whereby also with a cylindrical silencer housing, a fixation rail may be arranged according to the invention.

The silencer may be fixed to the gun via the fixation rail 30 such that the front end of the gun barrel engages with the receiving aperture 25 of the silencer. For fixing the silencer 10 to the gun, a connection rail 95 may be provided, as shown in FIG. 9*b*. The connection rail may be fixed at a mounting rail of the gun, and the silencer may be fixed to the connection rail by means of its fixation rail 30. According to an embodiment, the mounting rail of the gun may project beyond the front end of the gun barrel such that the silencer may be fixed to the mounting rail of the gun directly via its fixation rail 30.

The connection rail as well as also the part of the mounting rail projecting at the front are configured at the upper side such that the fixation rail 30 of the silencer may be slid on the connection rail or on the part of the mounting rail projecting at the front towards the gun barrel. Thereby, the silencer no longer has to be screwed onto the gun barrel, and it is avoided that the silencer is connected to the gun barrel fixedly such that the gun barrel is movable or may be moved independently of the silencer. This has advantages, in particular, with respect to guns operating according to the Browning principle, because the silencer does not have to be lifted. Moreover, a pulse generator may be omitted.

Further, a faster mounting and demounting is possible compared to screwable silencers.

At the lower side of the connection rail, a grip stock may be arranged such that the gun, for example, a pistol, may be held with both hands. The connection rail may be configured at the lower side as mounting rail in order to arrange or fix additional equipment, such as a tactical light, at the connection rail.

A transverse channel 33 (not shown in FIG. 1*a*) may be formed within the fixation rail 30 running substantially parallel to the transverse axis QA of the silencer 10. The transverse channel 33 is provided for receiving a locking or arresting means not shown here for locking the silencer at the mounting rail of the gun or at the connecting rail. With the locking or arresting means, it is ensured that the silencer 10 does not come loose from the gun autonomously.

Figure 1B:
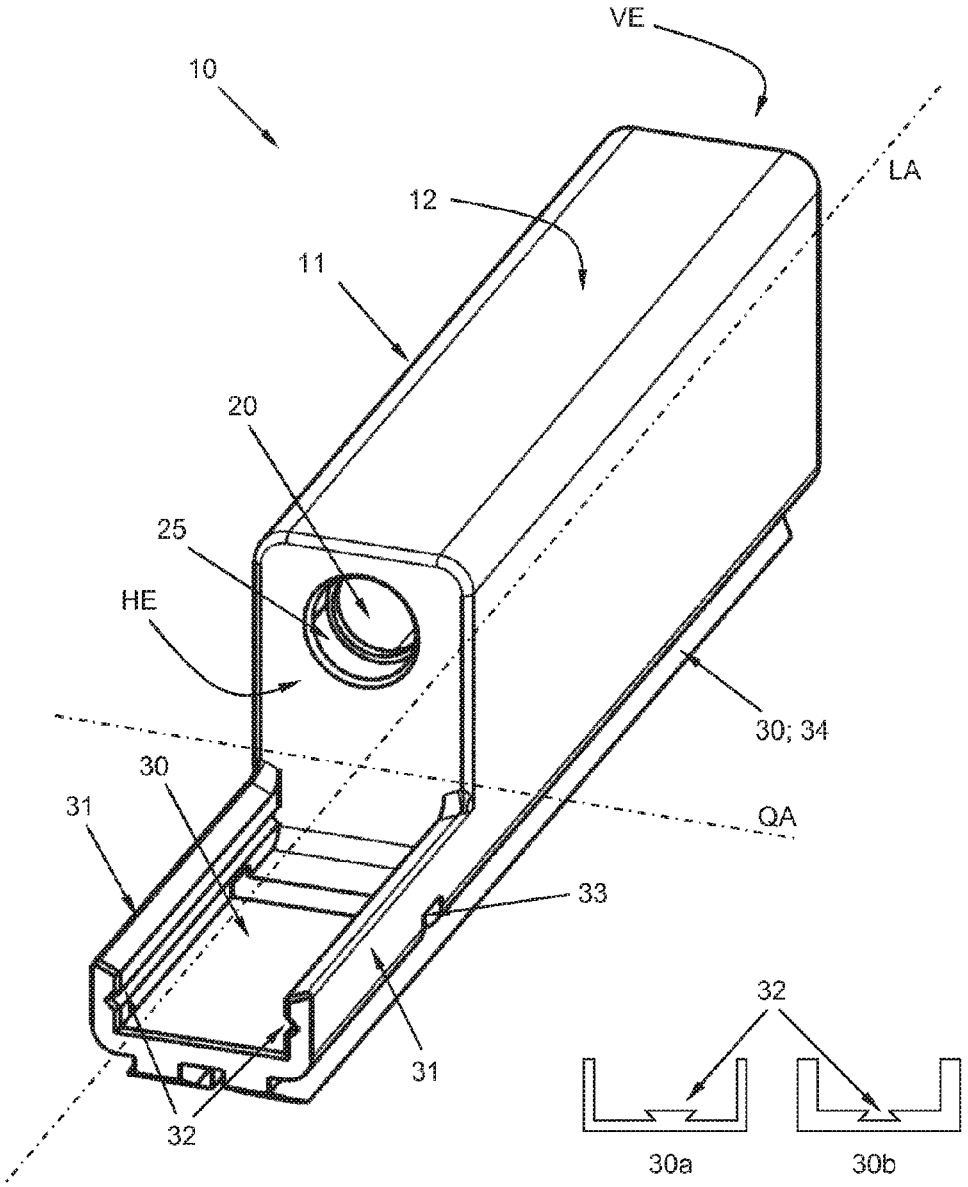
FIG. 1*b* shows a silencer according to the invention in a perspective view, as well as two alternative profiles of a fixation rail of the silencer according to the invention.

In FIG. 1*b*, an alternative embodiment of a silencer 10 according to the invention is shown with a mounting rail 30 in perspective view.

In the embodiment shown here, the silencer comprises a substantially rectangular solid silencer housing 11 and a fixation rail 30.

The silencer housing has a rear end wall HE, which in a mounted state faces the gun barrel of the firearm, and the front end wall VE opposing the rear end wall. Between the rear end wall and the front end wall, an upper wall 12 of the silencer housing is formed.

The silencer housing 11 may also have another shape than the rectangular solid shape shown here. In particular, the silencer housing may have a cylindrical shape, whereby a fixation rail may be arranged according to the invention also at a cylindrical silencer housing.

At the rear end or at the rear end wall HE of the silencer housing 11, a receiving aperture 25 is provided, with which the front end of a gun barrel engages or may be brought into engagement. In the interior and subsequent to the receiving aperture 25 of the silencer housing 11, a shot channel 20 for a bullet is formed running axially or parallel to the longitudinal axis LA.

The fixation rail 30 is arranged in the lower region of the silencer housing 11 and below the receiving aperture 25, and extends in the longitudinal direction, i.e., parallel to the longitudinal axis LA of the silencer housing 11 beyond the rear end wall HE. The fixation rail in the embodiment of a silencer according to the invention shown here, has a U-shaped profile. At the two side walls 31 of the U-shaped fixation rail 30, longitudinal guides 32 are provided, which run parallel to the longitudinal axis LA of the silencer 10.

In the embodiment of the fixation rail 30 shown in the perspective view of the silencer 10, each side wall 31 comprises a guide gap 32, which substantially extends over the entire length of the fixation rail 30.

The silencer 10 is fixed at a mounting rail of a firearm by means of the fixation rail 30 such that a front end of the gun barrel is brought into engagement with the receiving aperture 25 of the silencer. The internal profile of the fixation rail 30 is adapted to the external profile of the mounting rail of the firearm.

In a lower region of the fixation rail 30, a transverse channel 33 is formed, which substantially runs parallel to the transverse axis QA of the silencer 10. The transverse channel 33 is provided for receiving a locking and/or arresting means, which is not shown here, for locking the silencer at the mounting rail of the firearm. By means of the locking and/or arresting means, it is ensured that the silencer 10 is not able to detach from the gun autonomously.

At the lower side of the silencer 10, here, a mounting rail 34 is provided, which can be used for attaching additional accessories, for example, an additional handle or a tactical light. The mounting rail 34 extends in the embodiment of a silencer according to the invention shown here, over the entire length of the silencer 10, i.e., from the rear end of the fixation rail 30 to the front end or to the front end wall VE of the silencer housing 10. The mounting rail shown here may also have the function of a fixation rail 30 according to the invention.

The silencer according to the invention can be fixed at a mounting rail of a handgun by means of the fixation rail 30, whereby the longitudinal guides or guide gaps 32 are brought into engagement with correspondingly formed longitudinal guides of the mounting rail of the handgun at the mounting rail of the handgun. By means of the locking or arresting means arranged within the transverse channel 33, the silencer can be locked at the handgun, in order to prevent an autonomous or unintended axial movement of the silencer relative to the handgun. The locking or arresting means may be configured as passive or active locking or arresting means.

In FIG. 1*b*, further, two alternative profiles of a fixation rail 30 are shown.

According to a first alternative, a groove of a dovetail guide may be provided at the bottom of the fixation rail, which can be brought into engagement with a tongue of the dovetail guide of the mounting rail corresponding to the groove.

According to a second alternative, a tongue of the dovetail guide can be provided at the bottom of the fixation rail, which can be brought into engagement with a tongue corresponding to the groove of a dovetail of the mounting rail.

The groove as well as the tongue of the dovetail guides shown in the two alternatives extend in axial direction and parallel to the longitudinal axis LA of the silencer.

The longitudinal guides 32 shown in FIG. 1*b* may extend over the entire length of the fixation rail. However, it is also possible that the longitudinal guides only extend over a certain area, depending in the end on the concrete configuration of the corresponding longitudinal guides of the mounting rail of the gun. It is only important that the longitudinal guides 32 of the fixation rail correspond to corresponding longitudinal guides at the mounting rail, and allow for a movement of the silencer along the longitudinal axis LA relative to the handgun, as far as the silencer is not locked at the mounting rail.

With the silencer shown here, a particularly fast and particularly easy mounting of the silencer at the handgun is possible. This is because the silencer only has to be pushed onto the mounting rail of the handgun, which is provided below the barrel, and until the front end of the barrel is brought into engagement with the receiving aperture 25 of the silencer or until the locking and/or arresting means locks the silencer at the gun or at the mounting rail of the gun within the transverse channel 33. Also, a particularly simple and fast demounting of the silencer from the handgun is possible. Only the locking or arresting means has to be released and the silencer can be pulled off the mounting rail of the handgun.

Because the silencer is not fixed at the movable slide/breech or at the movable barrel, but rather at the frame of the gun or at the mounting rail of the gun, the barrel is able to move backwards independently of the silencer such that a self-loading function of the gun is not impaired by the silencer. Because the front end of the barrel engages with the receiving aperture 25 of the silencer, and because the silencer is not fixed to the barrel but rather at the frame of the gun, a pulse generator neither has to be provided. In particular, the silencer according to the invention may also be used for guns with a so-called pivoting barrel, whereby also there, no pulse generator is necessary.

In FIG. 2 to FIG. 9*a* and FIG. 10, further embodiments of the silencer shown in FIG. 1*b* are shown, according to which the fixation rail is arranged at the rear end face HE, or according to which the fixation rail is arranged at the lower side of the silencer and projects beyond the rear end face HE. The further embodiments of the invention shown in FIG. 2 to FIG. 9*a* and FIG. 10 can be applied analogously and accordingly also to the silencer shown in FIG. 1*a*.

Figure 2:
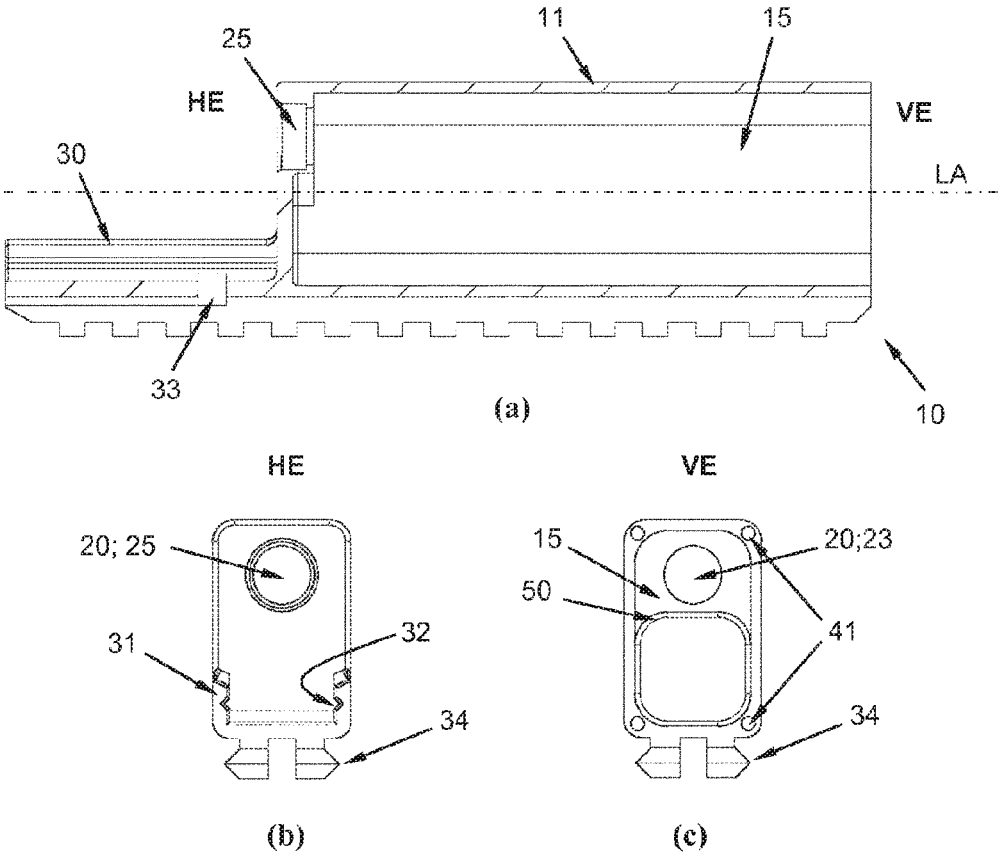
FIG. 2 shows a silencer according to the invention in sectional view along the longitudinal axis of the silencer, as well as a view of the front end and the rear end of the silencer.

FIG. 2 shows a silencer according to the invention in a sectional view along a longitudinal axis LA of the silencer, as well as a view of the rear end HE and a view of the front end VE of the silencer.

In the figure (a) of FIG. 2, a longitudinal section of the silencer 10 is shown, whereby the fixation rail extends in axial direction, i.e., parallel to the longitudinal axis LA beyond the rear end or beyond the rear end wall HE of the silencer housing 11. In an upper portion of the silencer housing 11, the receiving aperture 25 for receiving the front end of a gun barrel is provided. In the interior of the silencer housing 11, a gas chamber 15 is formed.

In the figure (b) of FIG. 2, a view from the rear of the silencer 10 is shown. Here, the configuration of the longitudinal guides or longitudinal gaps 32 can be seen, which have a substantially wedge shaped profile. The configuration of the mounting rail provided at the lower side of the silencer 10 for receiving additional equipment at the lower side of the silencer can be seen here also.

Figure 3:
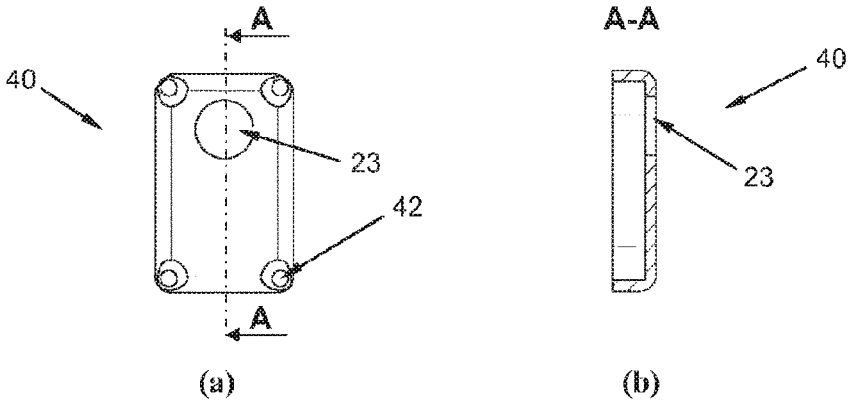
FIG. 3 shows a cover for covering the front end of the silencer.

In the figure (c) of FIG. 2, the view from the front of the silencer 10 is shown. In the illustration shown here, the silencer is open and may be closed by a cover, as shown in FIG. 3. In the interior of the silencer housing, a structured insert 50 is arranged, by means of which the expansion of the explosively expanding gases can be controlled. The concrete configuration or shape of the insert 50 is not important for the present invention and is only shown exemplary here. The silencer housing 11 in the embodiment shown here comprises at the front end VE four boreholes 41, into which the cover shown in FIG. 3 can be screwed by means of fixation screws.

According to an alternative embodiment of the invention, the silencer housing 11 may also be closed at the front side VE.

FIG. 3 shows in figure (a) a cover 40 for closing or covering the front end VE of the silencer housing 11, as far as the silencer housing is not closed at the front end. The cover 40 has a muzzle opening 23, through which the bullet fired off can exit. The cover 40 has bore holes 42, which correspond to the bore holes 41 of the silencer housing, and by means of which the cover 40 can be fixed at the silencer housing 11.

In the figure (b) of FIG. 3, a section of the cover 40 along the sectional axis A-A is shown. It can be seen here that the cover 40 has a substantially trough-like shape, which has the advantage that by attaching the cover 40 at the silencer housing 11, the volume of the gas chamber 15 can be increased. With differently deep trough-shaped covers, different volumes of the gas chamber 15 can be realized.

Figure 5:
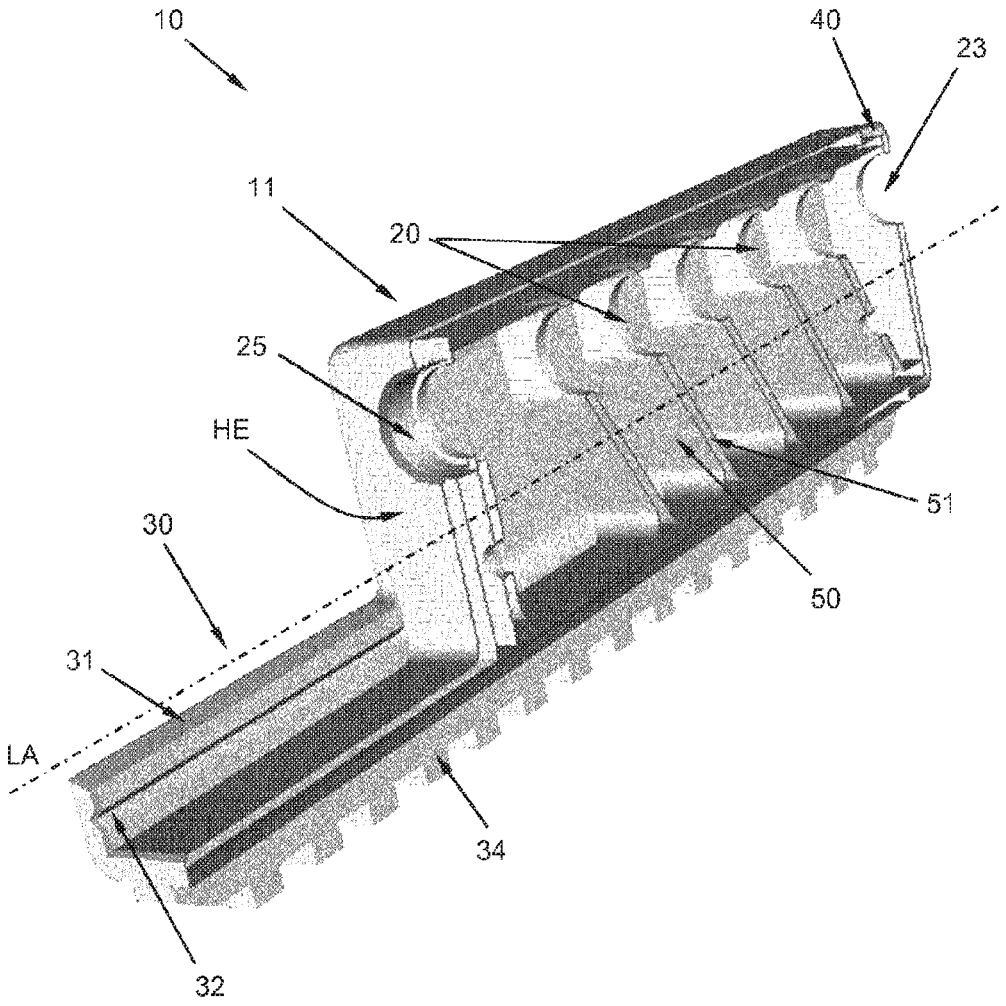
FIG. 5 shows a perspective sectional view along the longitudinal axis of the silencer according to the invention.

Further, by this, differently long structured inserts 50—as they are shown, for example, with reference to FIG. 5—can be inserted.

According to an alternative configuration, the cover 40 may also be formed flat, i.e., not trough-shaped.

Figure 4:
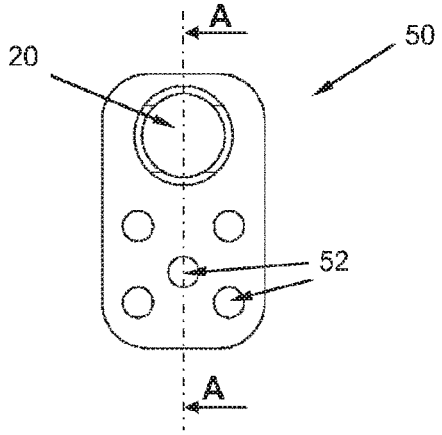
FIG. 4 shows an insert of the silencer in a view from the front as well as a sectional view along the longitudinal axis.
Figure 4:
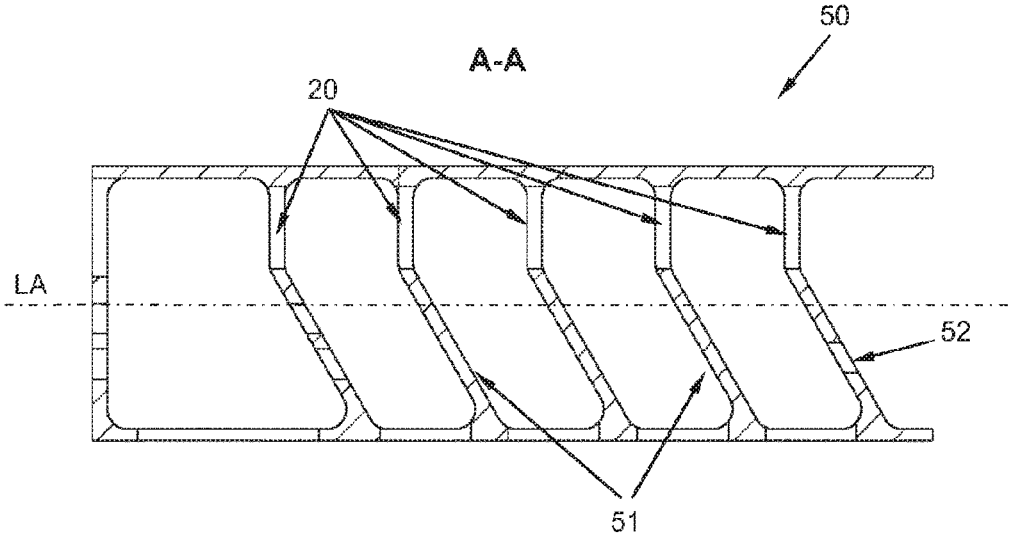

FIG. 4 shows an example of a structured insert 50 for a silencer 10 according to the invention.

In the figure (a) of FIG. 4, the insert 50 is shown in a view from the front, and in figure (b) of FIG. 4, the insert 50 is shown in a sectional view along the longitudinal axis LA. The external profile of the insert 50 substantially corresponds to the internal profile of the gas chamber 15 of the silencer 10 such that the insert 50 can be pushed into the gas chamber 15 of the silencer 10 so as to be substantially flush with it.

The insert 50 here has a number of fins 51, which at least partially are inclined backwards at a slanted angle, and wherein some of the blades have longitudinal bores 52. In the upper region of the fins, a shot channel 20 is formed such that the bullet may pass through the insert unimpededly. The structure, number, and configuration of the fins 51 may differ from the fins shown in FIG. 4, and basically depends on the concrete requirements to the sound absorbing properties of the silencer.

FIG. 5 shows a perspective view of a silencer 10 according to the invention in a sectional view along the longitudinal axis LA of the silencer. Here, the longitudinal guides 32 along the side wall 31 of the fixation rail 30 can be seen. Further, here the silencer housing 11 can be seen with the cover 40 fixed to the front end of the silencer housing 11, as well as the insert 50 having a number of fins 51 arranged within the interior of the silencer housing 11. A shot channel 20 is formed within the insert 50, which extends between the receiving aperture 25 and the muzzle opening 23 of the silencer or of the silencer housing 11. Also, the mounting rail 34 arranged at the lower side of the silencer 10 can be seen here, which has a number of transverse ribs, whereby the transverse ribs substantially are provided for locking additional equipment attached to the mounting rail 34.

The silencer housing 11 and the fixation rail 30 projecting at the rear end or at the rear end wall HE of the silencer housing and running parallel to the longitudinal axis LA may be configured in one part. Alternatively, the silencer housing 11 and the fixation rail 30 may also be configured as two parts, whereby the fixation rail 30 can be attached to the rear end of the silencer. According to still a further embodiment of the invention, the fixation rail 30 and the mounting rail 34 may be configured as one part, whereby the silencer housing 11 can be fixed to the upper side of the mounting rail 34 releasably. Thereby, it is possible to mount one and the same silencer housing to different attachment rails, which are adapted to different mounting rails of a gun.

Figure 6:
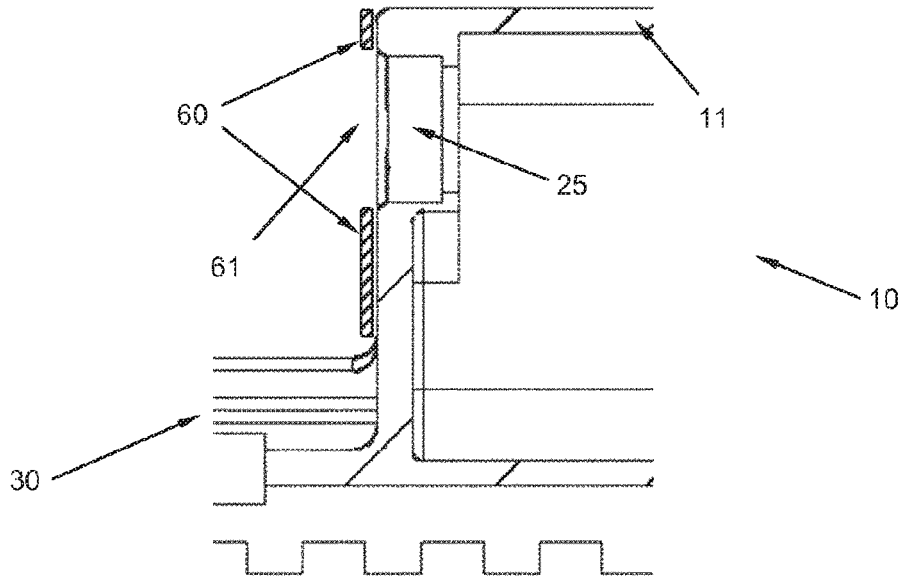
FIG. 6 shows an alternative embodiment of the silencer according to the invention with a cover plate, as well as two possible embodiments of the cover plate.
Figure 6:
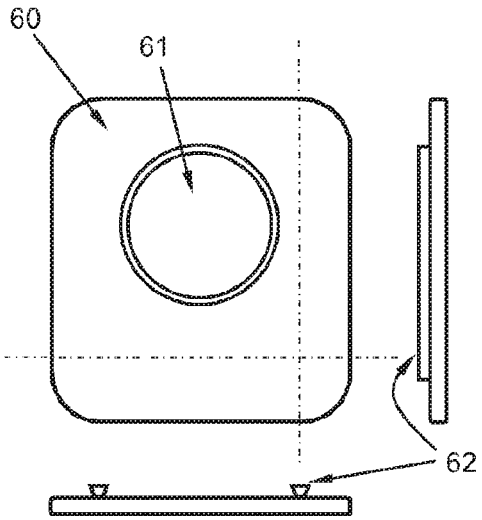
Figure 6:
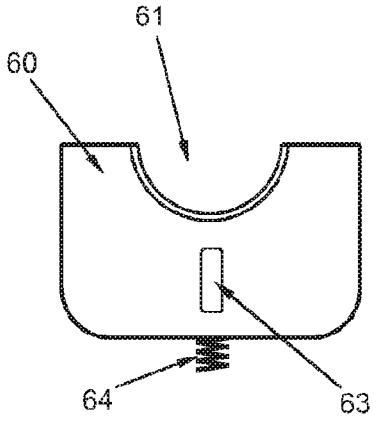

FIG. 6 shows a further development according to the invention of a silencer 10 according to the invention.

In figure (a) of FIG. 6, the rear region of the silencer 10 or the silencer housing 11 is shown in a sectional view. In figure (b) of FIG. 6, a first embodiment of a cover plate 60 is shown, and in figure (c) of FIG. 6, a second embodiment of a cover plate 60 is shown.

At the rear end of the silencer housing 11, a cover plate 60 is provided, which is arranged at or abuts against the rear end wall HE of the silencer housing 11. The cover plate 60 is movable upwards or relative to the silencer housing 11. Further, an opening or recess 61 is provided in the cover plate 60, which essentially has the same shape and the same size, preferably slightly larger, as the receiving aperture 25 of the silencer. The front end of the gun barrel may be brought into engagement with the receiving aperture 25 of the silencer through the opening 61 of the cover plate 60.

The use of the cover plate 60 shown here is particularly advantageous in a case, where the silencer according to the invention is used for guns having a barrel which is movable and pivoting backwards. With respect to such handguns, the front end of the gun barrel is moved out of the receiving aperture 25 of the silencer in axial direction after firing off of a bullet. The rear end of the gun barrel is then tilted slightly downwards for the purpose of reloading, whereby the front end of the gun barrel slightly tilts upwards, leading thereto that a relatively large area of the receiving aperture 25 is completely open, and gases may be discharged through this opening.

The cover plate 60 now is provided to substantially prevent during the loading procedure that a larger area of the receiving aperture 25 is open, when the front end of the barrel is tilted forwards. The cover plate 60 is configured or is arranged at the silencer housing 11 such that the cover plate 60 with a front end of the gun barrel tilting forwards also moves upwards—and, in fact, synchronously with the front end of the barrel—such that the cover plate 60 moving upwards through the opening of the receiving aperture 25 closes again by an upwards tilting of the front end of the gun barrel. After the loading procedure, the front end of the gun barrel moves downwards again and into the receiving aperture 25, whereby at the same time also the cover plate 60 is moved downwards again.

Figure (b) of FIG. 6 shows a first embodiment of a cover plate 60. The cover plate 60 consists of a substantially flat plate having an opening or recess 61. The diameter of the opening or recess 61 substantially corresponds to the diameter of the receiving aperture 25 such that the front end of a gun barrel may penetrate through the opening 61 unimpededly. According to an embodiment of the cover plate 60, the rim of the opening 61 may be slightly chamfered.

At the rear side or at the side of the cover plate 60 facing the silencer housing 11, here, two guide rails 62 running perpendicular are provided, which here are formed as a groove of a dovetail guide. A first one of the two guide rails 62 extends on the right-hand side of the opening 61, and a second one of the two guide rails 62 extends on the left-hand side of the opening 61.

At the rear end wall HE of the silencer housing 11, also corresponding guide rails are provided, with which the guide rails 62 of the cover plate 60 may be brought into engagement. For example, two tongues of a dovetail guide extending perpendicular and corresponding to the guide rails 62 of the cover plate 60 may be provided in the rear end wall of the silencer housing 11. The cover plate 60 may then be moved upwards or downwards along the guide rails at the rear end wall of the silencer housing 11.

With respect to the cover plate 60 shown in figure (b), the front end projecting from the receiving aperture 25 of the silencer and tilting upwards picks up the cover plate 60 such that substantially the lower half of the cover plate closes the opening of the receiving aperture 25, which is formed during the loading procedure.

In figure (c) of FIG. 6, an alternative embodiment of a cover plate 60 is shown. The cover plate 60 has at the upper end, a rim-sided semi-circular recess 61, the radius of which substantially corresponds to the radius of the receiving aperture 25 of the silencer or to the radius of the front end of the gun barrel. At the lower end of the cover plate 60, a spring member 64 is provided. The spring member 64 pushes the cover plate against the gun barrel from below such that during the tilting of the front end of the gun barrel upwards, the cover plate 60 also is moved upwards due to the spring force of the spring member 64, and thereby closes the opening in the receiving aperture 25 being formed during the loading procedure.

The embodiment of the cover plate 60 shown in figure (c) compared to the cover plate 60 shown in figure (b) has the advantage that the gun barrel does not have to push the cover plate upwards, but rather the spring member 64 pushes the cover plate upwards such that the gun barrel may tilt forwards unimpededly and without any resistance.

According to the embodiment of a cover plate 60 shown in figure (c), also guide rails 62 may be provided, as shown in figure (b).

According to the embodiment shown in figure (b), also a spring member 64 may be provided, by means of which a moving of the cover plate upwards can be supported.

According to the cover plate 60 shown in figure (c), a hole 63 is provided in a lower area of the cover plate, which here is formed as an elongated hole. The cover plate having the elongated hole 63 is advantageous in such a case, if the cover plate is used together with a silencer, as will be described with reference to FIG. 7, FIG. 9*a* and FIG. 9*b*. The configuration of the hole 63 as elongated hole is advantageous, in order not to interrupt a light ray passing through the hole 63 during a movement of the cover plate 60 upwards.

A corresponding hole or elongated hole 63 may also be provided in a cover plate 60 according to figure (b).

In figure (a) of FIG. 6, a small gap is provided between the cover plate 60 and rear end wall of the silencer housing 11. However, it is nevertheless advantageous, if this gap is as small as possible, in order to ensure a covering as good as possible of the opening of the receiving aperture 25 being formed during the loading procedure.

Figure 7:
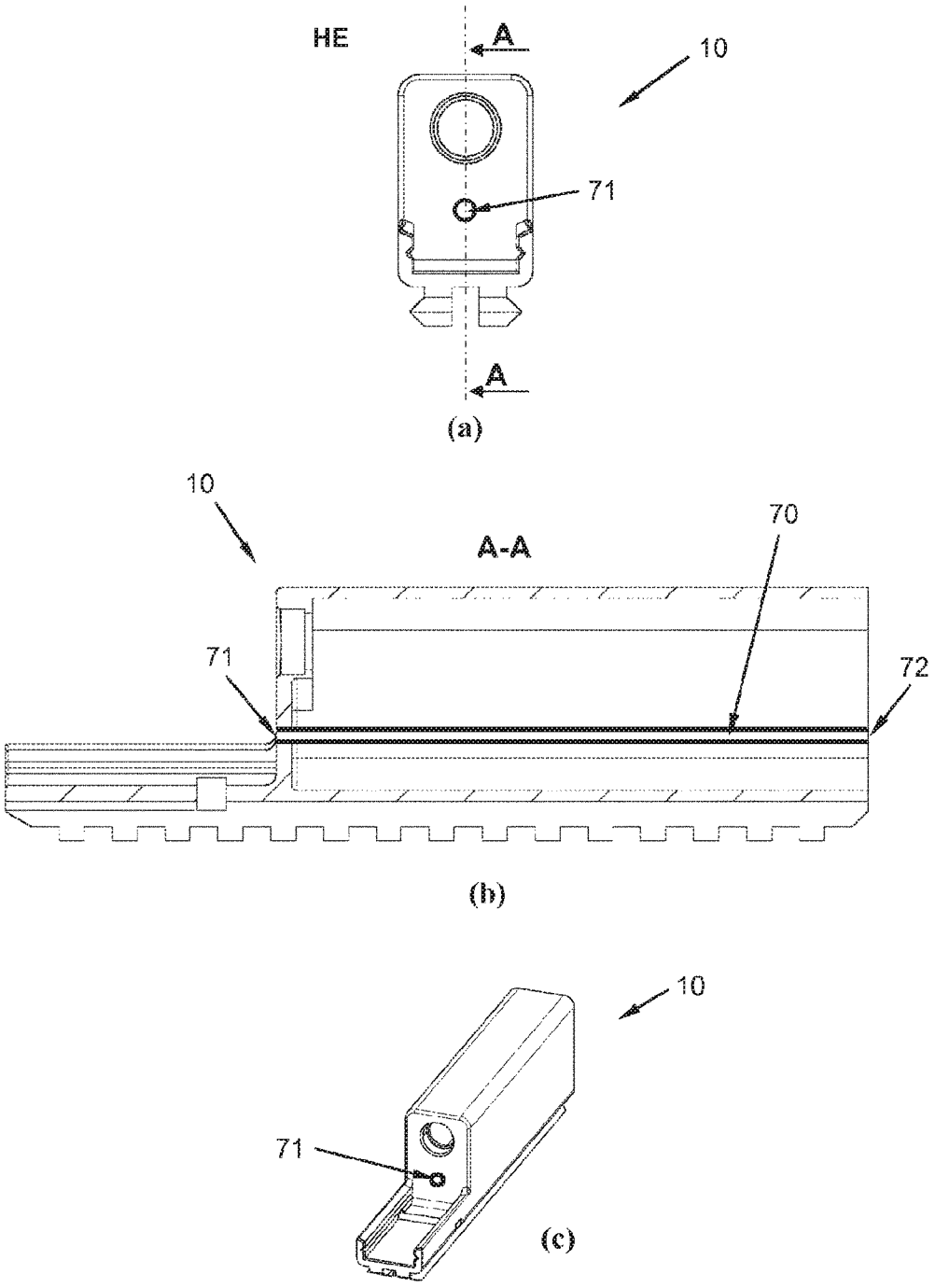
FIG. 7 shows a further embodiment of the silencer according to the invention in a view from the rear, in a sectional view along the longitudinal axis, as well as in a perspective view.

FIG. 7 shows a further development according to the invention of a silencer 10 according to the invention, whereby in figure (a), the rear end HE, in figure (b) a sectional view along the longitudinal axis of the silencer, and in figure (c) a perspective view of the silencer are shown.

Here, a light channel 70 is arranged within the silencer 10 or within the silencer housing 11, which has an inlet opening 71 and an outlet opening 72, and which extends from the rear side wall to the front side wall of the silencer housing. The light channel 70, here is formed as a cylindrically shaped channel, through which a light ray may pass through unimpededly from the inlet opening 71 up to the outlet opening 72.

A silencer configured according to FIG. 7 having a light channel 70 may, for example, be employed, if the handgun has a light source, as a laser pointer, for example, at the front end or below the gun barrel. The laser pointer may be arranged, for example, at the front end of the closing or return spring, or at or in the spring sleeve of the closing or return spring of the gun. A corresponding configuration is shown with reference to FIG. 9*a* and FIG. 9*b*.

The light channel or light cylinder 70 may be made from stable plastics or from a metal, which is fixed to the front sided or rear sided end wall of the silencer housing in an air or pressure tight manner. When using an insert 50, as shown with reference to FIG. 4, the light channel or light cylinder 70 may be passed through the fins 51 of the insert. The fins 51 may then provide for additional stability of the light channel 70.

In an embodiment of the invention, the light channel 70 may be provided as a component of the insert 50, and may be connected to the insert 50 fixedly such that the light channel 70 may be removed from the silencer housing 11 together with the insert. According to this embodiment, it only has to be taken care of the light channel 70, after insertion of the insert into the silencer housing 11, being sealed against the gas chamber 15 in an air or pressure tight manner.

Figure 8:
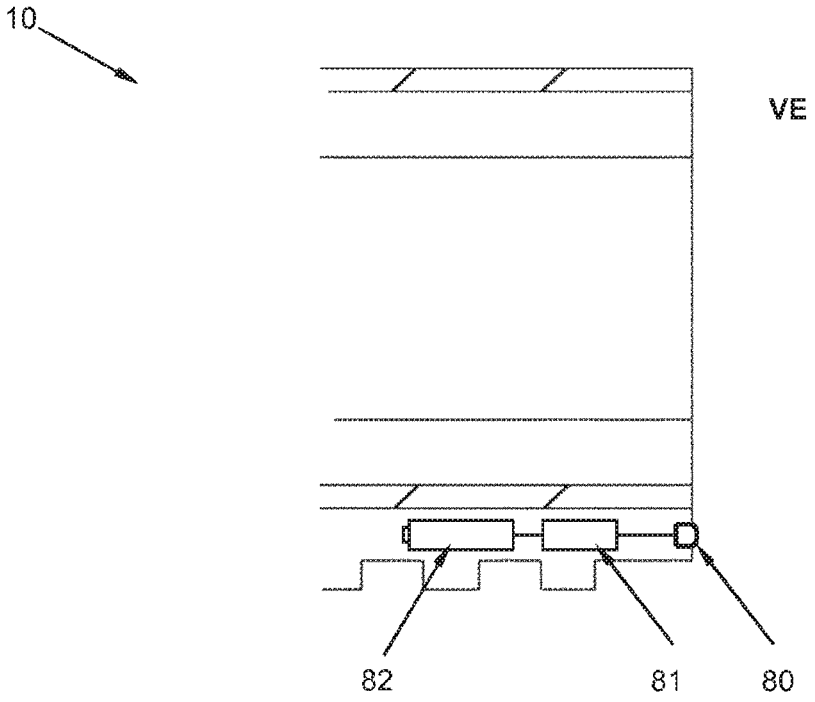
FIG. 8 shows the front end of a silencer according to the invention with an illuminant means arranged therein.
Figure 8:
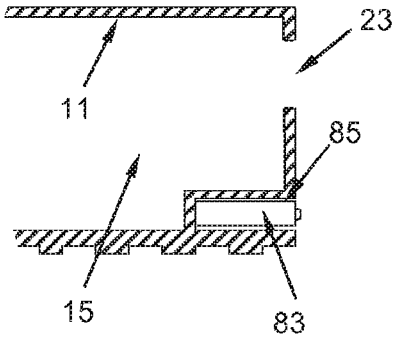

FIG. 8 shows in figure (a) the front end VE of a silencer according to the invention according to a further embodiment in a sectional view.

With respect to the silencer 10 shown in FIG. 8, an illuminant 80 is arranged in the front region or at the front end wall of the silencer housing, which here is configured as laser diode. The illuminant 80 may be coupled to electronics 81, by means of which the function or the operation of the illuminant 80 may be controlled. For example, the intensity of the laser diode may be controlled. The illuminant 80 and the electronics 81, here, are coupled to a power supply 82, as for example, a battery.

According to an embodiment of the invention, the illuminant 80, the electronics 81, and the power supply 82 are accommodated within a housing 83, whereby the illuminant 80 is arranged within an opening of the housing, as shown in figure (b) of FIG. 8. Preferably, the housing 83 is configured in an air or pressure tight manner such that it may be arranged within the interior of the silencer housing 11. The silencer housing may comprise, at the front end, a support 85, into which the housing 83 with the illuminant, the electronics, and the power supply may be inserted and locked. Thereby, a modular illuminant means can be provided, which may be removed from the silencer as needed, or which may be replaced by another illuminant module.

If the support 85 is formed in an air or pressure tight manner against the gas chamber 15, then a pressure or air tight configuration of the housing 83 of the illuminant module may be omitted, thus enabling a simpler production of the illuminant module.

Figure 9A:
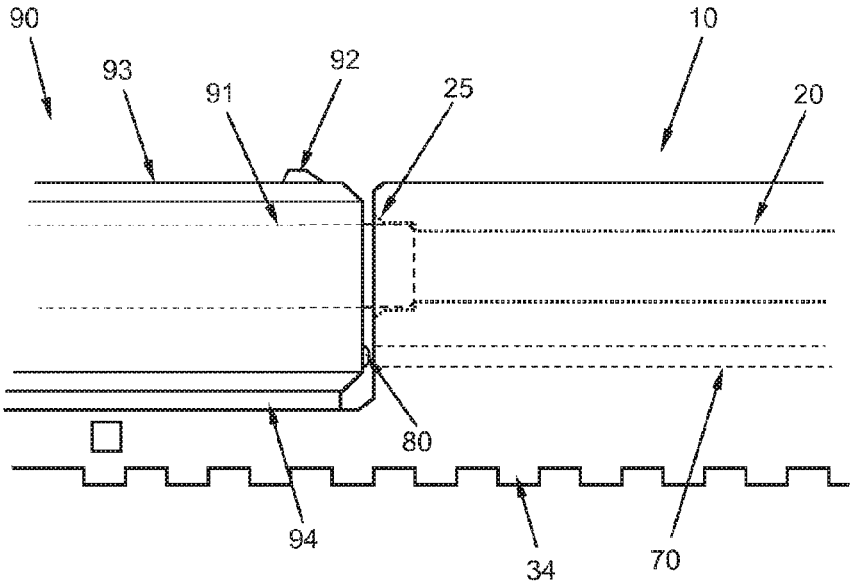
FIG. 9*a* shows a silencer according to the invention mounted at the gun.
Figure 9A:
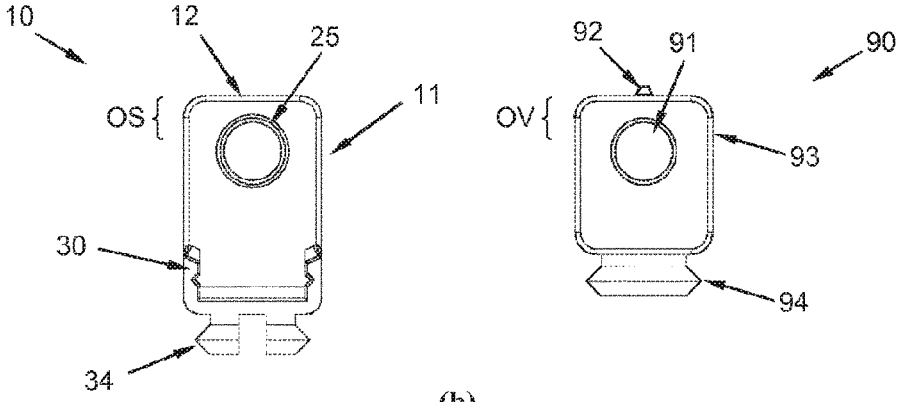
Figure 9B:
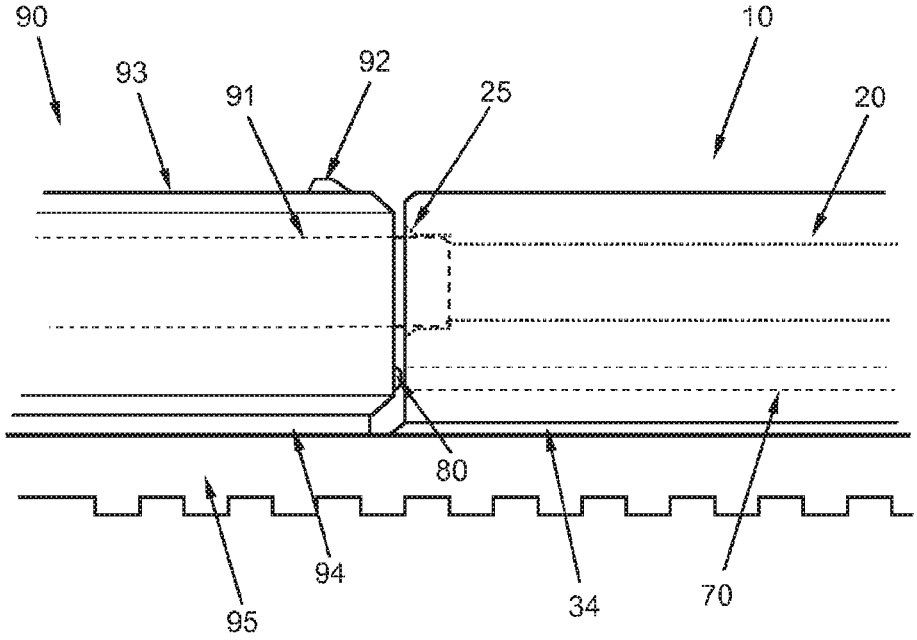
FIG. 9*b* shows a silencer according to the invention mounted at the gun, wherein mounting is effected via a connection rail.

FIG. 9*a* shows in figure (a) a silencer 10 according to the invention, which is arranged or fixed at a mounting rail 94 of a gun 90. The gun barrel or the front end of the gun barrel 91, here, protrudes into the receiving aperture 25 of the silencer 10, whereby the front end of the gun barrel 91 may close the silencer housing or the gas chamber of the silencer housing preferably in an air or pressure tight manner.

Below the gun barrel, a laser diode 80 is provided at the gun, the optical axis of which coincides with the longitudinal axis of the light channel 70.

At the front end of the gun 90, a bead 92 is provided at the breech 93 of the gun 90, whereby due to the particular shape of the silencer housing 11, no modifications to the bead 92 are necessary, if the gun is used in combination with the silencer according to the invention.

Also due to the specific shape of the silencer according to the invention, the gun sight of the gun is also usable during use of the silencer.

Due to the specific configuration of the silencer, i.e., due to the substantially cuboid shape of the silencer housing, it is possible to build the silencer housing 11 substantially shorter than with respect to common cylindrically shaped silencers. This has the advantage that a holstering of the gun also is possible with a silencer mounted thereto.

In order to achieve the advantages mentioned above, it is advantageous, if the external profile of the upper portion OS of the silencer housing 11 of a silencer 10 substantially has the same external profile as an upper portion OV of the breech 93 of a gun 90, as shown with reference to figure (b) of FIG. 9*a*.

FIG. 9*b* shows the silencer 10 according to the invention shown in FIG. 1*a*, which is arranged or fixed at a mounting rail 94 of a gun 90 via a connection rail 95. The gun barrel or the front end of the gun barrel 91, here, protrudes into the receiving aperture 25 of the silencer 10, whereby the front end of the gun barrel 91 is able to close the silencer housing or the gas chamber of the silencer preferably in an air or pressure tight manner.

The silencer may be simply slid onto the connection rail 95 until the front end of the gun barrel 91 protrudes into the receiving aperture 25, and may then be locked.

Above, a silencer has been described, which is provided according to its intended reduction of sound emission during firing off a shot from a gun. According to a further embodiment according to the invention, the silencer may also be used as duel simulator.

Figure 10:
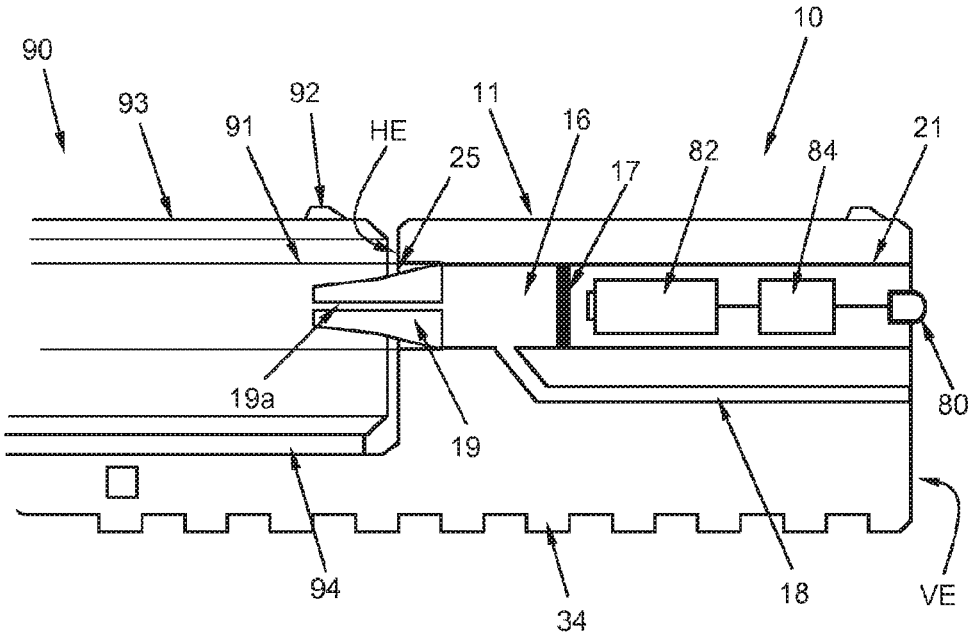
FIG. 10 shows a silencer according to the invention, which is configured as duel simulator according to the invention.

FIG. 10 shows a further configuration of a silencer according to the invention, which can be used as duel simulator, for example, for training and/or educational purposes, whereby blank and maneuver bullets are employed.

During use of blank and maneuver bullets in guns having a self-loading function, the problem exists that the blank and maneuver bullets during firing off in most of the cases do not generate or establish sufficient pressure, in order to move the breech of the gun fast enough and/or wide enough backwards, such that the used bullet sleeve is ejected and a new bullet may be loaded.

For solving this problem, the silencer 10 according to the invention is further developed in that the silencer may be used as duel simulator. The silencer used as duel simulator is configured according to the invention such that it is ensured that also with the use of blank and/or maneuver bullets, the self-loading function of the gun still is maintained.

The basic structure of a silencer 10 used as duel simulator basically corresponds to the one shown in FIG. 1*a* and FIG. 1*b*. Accordingly, the duel simulator comprises a silencer housing 11 and a fixation rail 30, whereby the fixation rail 30 is fixed or arranged at the silencer housing, as shown with reference to FIG. 1*a* and FIG. 9*b*.

When using a silencer according to the invention as duel simulator, the silencer housing 11 may, however, be formed substantially shorter than with respect to the silencers shown with respect to FIG. 1*a* to FIG. 9*b*, because the volume of an expansion space for the expanding gases of the blank and/or maneuver bullets may or has to be substantially smaller than the volume of the expansion space of a duel simulator of a silencer used as intended. The expansion space of a duel simulator, therefore, should be selected smaller than the volume of an expansion space of a common silencer already for the reason to provide a sufficiently strong return force or pressure for the returning of the breech.

In the interior of the silencer housing 11, an expansion space 16 is formed in the rear area, which follows to the receiving aperture 25 of the silencer housing 11 such that during firing off of a blank and/or maneuver bullet, the gases expanding in the gun barrel 91 may reach the expansion space 16. By the relatively small sized expansion space 16, it is ensured that the gas entering into the expansion space establishes a pressure, which ensures a reliable functioning of the self-loading function of the gun.

The expansion space 16 may be connected to an overpressure channel 18, which leads up to the front end wall VE of the silencer housing 11. The gases expanding in the expansion space 16 are lead to the outside via this overpressure channel 18 such that the pressure within the expansion space is reduced again. The overpressure channel 18 preferably is sized such that in spite of discharging the gases from the expansion space 16, there will be established a sufficiently high pressure within the expansion space 16, which is sufficient for the self-loading function of the gun, and such that the pressure within the expansion space is reduced to a normal level until the next shot is fired off.

The expansion space 16 of the duel simulator after mounting the duel simulator on the gun 90 is coupled to the gun barrel 91 pressure-tight such that between the expansion space and the gun barrel, as little gas as possible is able to escape. With such a pressure-tight coupling of the expansion space to the gun barrel, a reducer 19 for blank and/or maneuver bullets may be omitted.

According to an embodiment of the duel simulator, the latter may also be used together with a reducer 19 being arranged at the muzzle opening of the gun barrel 91. The reducer 19 is screwed into the muzzle opening of the gun barrel 91 or is screwed onto the muzzle opening of the gun barrel and ensures that after firing off of a shot, a sufficient pressure is established within the gun barrel 91 in order to ensure a proper functioning of the self-loading function of the gun also during the use of blank and/or maneuver bullets.

The reducer has a substantially conical shape in the embodiment shown here. The reducer may, however, also have any other arbitrary suitable shape. The reducer 19 has a longitudinal channel 19*a*, through which the gas expanding in the gun barrel 91 may escape. When using the duel simulator according to the invention, the front end of the reducer 19 protrudes into the receiving aperture 25 of the duel simulator. Preferably, the reducer 19 seals the expansion space 16 in a pressure tight manner against the receiving aperture 25.

When using the duel simulator according to the invention together with a reducer 19 arranged at the gun, the expansion space 16 is provided in the first line to discharge the gases exiting from the reducer 19 via the overpressure channel 18. Nevertheless, the expansion space 16 may be provided when being used together with a reducer 16 such that a pressure necessary for the maintenance of the self-loading function of the gun is established and reached such that the expansion space 16 basically fulfils the same function as when using the duel simulator without a reducer 19 being arranged at the gun barrel.

In the embodiment of a silencer used as duel simulator shown here, the expansion space 16 is arranged substantially coaxially to the gun barrel 91, and basically has the same diameter as the gun barrel 91.

In the housing 11 of the duel simulator, here, a receiving channel 21 is provided, which runs parallel to the longitudinal axis of the housing 11, and which extends from the rear end wall HE up to the front end wall VE of the housing 11. In the rear region, i.e., in the portion of the receiving channel 21 facing the rear end wall HE, the expansion space 16 described above is formed, whereby a bulkhead 17 is arranged in the receiving channel 21, which separates the rear region of the receiving channel from the front region of the receiving channel pressure and gas tightly. The overpressure channel 18 leads into the rear region of the receiving channel 21, which forms the expansion space 16.

According to a specific configuration of the duel simulator according to the invention, the bulkhead 17 can be moved in longitudinal direction relative to the receiving channel 21, and the receiving channel may be locked. Thereby, differently large expansion spaces can be formed such that the size of the expansion space 16 may be adapted to the blank and/or maneuver bullets used, if needed. For example, when using a blank cartridge, which generates a pressure which is too low for the proper functioning of the self-loading function of the gun, the expansion space 16 may be reduced in size correspondingly, coming up to an effective pressure increase.

The receiving channel 21, here, is formed cylindrically. The receiving channel may, however, also have any other shape, for example, it may have a rectangular or square profile. In particular, the front region of the receiving channel 21 may have another profile than the rear region, which forms the expansion space 16.

In the front region of the receiving channel 21, a power supply, for example, a battery, a sensor unit and a laser diode are arranged. The battery 22 serves for energy supply of the sensor unit 84 of the laser diode 80.

The sensor unit may, for example, comprise an acoustic sensor, by means of which the firing off of a blank or maneuver bullet may be detected acoustically.

Alternatively, the sensor unit 84 may also comprise a pressure sensor, by means of which a pressure increase within the expansion space 16 may be detected, which is effected by the firing off of a blank or maneuver bullet.

Further, an evaluation or control means not shown here is arranged in the receiving channel 21, which is coupled operatively to the sensor unit 84. The evaluation and/or control unit is adapted to evaluate the sensor signal provided by the sensor unit 84, and to control the laser diode 80 depending on the evaluation result. Preferably, the evaluation or control means is adapted to instruct the laser diode 80 to emit a laser beam after detection of a shot fired off. According to a further particular embodiment of the invention, after the detection of a firing off of a shot, an encoded laser beam is emitted from the laser diode. The encoded laser beam may, for example, comprise an identification number of the shooter and information on the guns and/or type of ammunition used.

The duel simulator may be configured in a modular manner, whereby the receiving channel 21 together with the overpressure channel 18 forms a module, which can be inserted into the housing 11. Thereby, different modules may be inserted into the housing 11, which respectively are adapted to the different requirements.

The use of the silencer according to the invention as duel simulator, as described with reference to FIG. 10, has the advantage that the duel simulator does not have to be screwed onto the gun barrel 91, but rather may be fitted at the mounting rail 94 of the gun, which enables a particularly quick mounting and demounting of the duel simulator at or from the gun.

According to the invention, the duel simulator may be fixed to the gun via a connection rail, as shown for a silencer with reference to FIG. 1*a* and FIG. 9*b*. For this, a mounting rail is provided at the lower side of the duel simulator, which can be brought into engagement with a corresponding guide of the connection rail.

According to the invention, a holster for holstering a handgun is provided, to which a silencer according to the invention may be mounted. The holster preferably is configured such that the gun may be holstered together with the silencer mounted thereto, providing the advantage that the gun always is ready to be used with the silencer mounted thereto. Due to the moderate length of the silencer according to the invention, such a holster may be configured as an armpit or shoulder holster, as belt holster, or as leg holster or thigh holster.

REFERENCE NUMERALS

10 silencer
11 silencer housing
12 upper wall of the silencer housing
13 lower wall of the silencer housing
15 gas chamber
16 expansion space
17 bulkhead
18 overpressure channel
19 reducer
19*a* longitudinal channel in the reducer
20 shot channel of the silencer
21 receiving channel
23 muzzle opening of the silencer
25 receiving aperture of the silencer
30 fixation rail (U-shaped) of the silencer
30*a*, 30*b* alternative profiles of the fixation rail
31 side wall of the fixation rail
32 longitudinal guide (e.g. guide gaps) of the fixation rail
33 transverse channel for receiving a locking or arresting means
34 mounting rail at the lower side of the silencer
40 cover (flat or trough-shaped)
41 bore holes at the front end of the silencer
42 bore holes at the cover
50 (structured) insert of the silencer
51 fins of the insert
52 longitudinal bores in the fins
60 cover plate
61 opening or recess in the cover plate
62 guide rail (e.g., groove of a dovetail guide)
63 hole (e.g., elongated hole) in the cover plate
64 spring member
70 light channel
71 inlet opening of the light channel
72 outlet opening of the light channel
80 illuminant (e.g., laser diode)
81 electronics of the illuminant
82 power supply for the illuminant (e.g., battery)
83 housing of the illuminant module
84 sensor unit
85 recess or support in the silencer for an illuminant module
90 gun
91 gun barrel
92 bead
93 breech or breech component
94 mounting rail at the lower side of the gun or below the breech component
95 connection rail
A-A section
HE rear end of the silencer or rear end wall of the silencer housing
LA longitudinal axis of the silencer
OS upper portion of the silencer housing
OV upper portion of the breech of the gun
QA transverse axis of the silencer
VE front end of the silencer or front end wall of the silencer housing

The invention claimed is:

1. A silencer (10) for a handgun, comprising
a silencer housing (11) with a rear end wall (HE), which faces a gun barrel (91) of the handgun, and with a front end wall (VE) opposing the rear end wall, and
a fixation rail (30) and a connection rail, the fixation rail arranged at the silencer housing for fixing the silencer to the connection rail, which is fixed to the handgun and which protrudes beyond the handgun barrel after fixation, wherein the silencer is fixed at the connection rail by means of said fixation rail,
wherein the fixation rail (30) is arranged at a lower side wall (13) of the silencer housing extending between the rear end wall (HE) and the front end wall (VE).

2. The silencer according to claim 1, wherein the fixation rail (30) extends parallel to a longitudinal axis (LA) of the silencer housing (11).

3. The silencer according to claim 1, wherein the fixation rail (30) has at least one longitudinal guide (32).

4. The silencer according to claim 3, wherein the at least one longitudinal guide (32) runs parallel to the longitudinal axis (LA) of the silencer housing (11).

5. The silencer according to claim 1, wherein the fixation rail (30) projects beyond the rear end wall (HE).

6. The silencer according to claim 5, wherein the fixation rail (30) has a substantially U-shaped profile.

7. The silencer according to claim 6, wherein the fixation rail comprises a first longitudinal guide and a second longitudinal guide, and wherein
the first longitudinal guide is formed at the inner surface of a first side wall of the U-shaped profile, and
the second longitudinal guide is formed at the inner surface of a second side wall of the U-shaped profile.

8. The silencer according to claim 1, wherein at least one partially open transverse channel (33) is formed in the fixation rail (30) for receiving a locking and/or arresting means.

9. The silencer according to claim 1, wherein the fixation rail (30) extends substantially over an entire length of the silencer housing (11).

10. The silencer according to claim 1, wherein the front end wall (VE) is configured as a cover (40) being releasable from the silencer housing (11), wherein the cover (40) is formed trough-shaped.

11. The silencer according to claim 1, wherein, in the silencer housing (11) between the rear end wall (HE) and the front end wall (VE), a light channel (20) running parallel to the longitudinal axis (LA) of the silencer housing is arranged with an inlet opening (71) at the rear end wall and an outlet opening (72) at the front end wall, wherein the light channel (20) is configured pressure and/or air-tightly against a gas chamber (15) of the silencer.

12. The silencer according to claim 1, wherein in the front end wall (VE), an illuminant (80) is arranged, wherein in the silencer housing (11), control electronics (81) and/or a power supply (82) for the illuminant (80) is/are provided, wherein the illuminant (80), the control electronics (81), and the power supply (82) are arranged within an air- and/or pressure-tight housing (83), wherein the illuminant (80) is arranged in a side wall of the housing, and wherein the housing and the components (80, 81, 82) arranged therein together form an illuminant module, wherein the control electronics (81) or the illuminant module comprises a sensor unit (84) for detection of a firing off of ammunition of blank and/or maneuver ammunition, wherein the sensor unit (84) comprises a pressure sensor and/or acoustic sensor.

13. The silencer according to claim 1, wherein the silencer is embodied as duel simulator, wherein in the silencer housing (11), an expansion chamber (16) is formed, into which an overpressure channel (18) leads for discharging gases expanding in the expansion chamber.

14. The silencer according to claim 13, wherein in the silencer housing (11), there is arranged a receiving channel (21) between the rear end wall (HE) and the front end wall (VE), wherein the expansion chamber (16) is formed within the receiving channel, wherein a bulkhead (17) is formed in the receiving channel, which delimits the expansion chamber (16) towards the front end wall (VE) and wherein the expansion chamber is arranged coaxially to a gun barrel (91), and on the gun side, can be coupled to the gun barrel substantially pressure-tightly, wherein the expansion chamber (16), on the gun barrel side, can be closed by a reducer (19) being arranged at the muzzle opening of the gun barrel (91), wherein the reducer has a longitudinal channel (19*a*), which connects the expansion chamber to the gun barrel, wherein the illuminant module is arranged behind the bulkhead (17), wherein the bulkhead (17) is movable within the receiving channel (21) preferably in longitudinal direction relative to the receiving channel (21), and wherein the control electronics (81) is adapted to, after a detection of a firing off of ammunition, instruct the illuminant (80) to emit a light ray, preferably, a laser beam, particularly preferred, an encoded laser beam.

15. The silencer according to claim 1, wherein a cover plate (60) is arranged in front of the rear end wall (HE) and substantially parallel to the rear end wall, which can be moved in vertical direction relative to the rear end wall and parallel to the rear end wall (HE), wherein the cover plate (60) has an opening or recess (61) which substantially has the same size and shape as the receiving aperture, wherein a spring member (64) is arranged at the lower side of the cover plate (60), wherein at the side of the cover plate (60) facing the rear end wall (HE), guide rails or guide gaps (62) are provided, which engage with guide gaps or guide rails at the rear end wall, and wherein a hole (63) is provided in the cover plate (60) below the opening or recess (61).

16. The silencer according to claim 1, wherein the silencer housing (11) and the fixation rail (30) are formed as one part.

17. The silencer according to claim 1, wherein exactly one fixation rail (30) is provided.

18. A handgun, comprising a silencer according to claim 1.

19. A holster for holstering a gun a handgun, characterized in that the holster is adapted to holster a gun with a silencer fixed thereto according to claim 1.

* * * * *